US007841372B2

(12) United States Patent
Gill

(10) Patent No.: US 7,841,372 B2
(45) Date of Patent: Nov. 30, 2010

(54) APPARATUS FOR HARDENING THE HEAD AREA OF A WOODEN BASEBALL BAT

(76) Inventor: William H. Gill, 1353 Route 179, Lambertville, NJ (US) 08530

( * ) Notice: Subject to any disclaimer, the term of this patent is extended or adjusted under 35 U.S.C. 154(b) by 306 days.

(21) Appl. No.: 12/152,476

(22) Filed: May 15, 2008

(65) Prior Publication Data

US 2008/0308184 A1 Dec. 18, 2008

Related U.S. Application Data

(60) Provisional application No. 60/934,590, filed on Jun. 15, 2007.

(51) Int. Cl.
*B27C 9/00* (2006.01)

(52) U.S. Cl. ..... 144/2.1

(58) Field of Classification Search ..... 144/2.1, 144/3.1, 12, 30, 256.1, 259, 262, 260, 361, 144/381; 100/171, 210, 211, 913; 473/44, 473/564

See application file for complete search history.

(56) References Cited

U.S. PATENT DOCUMENTS

| | | | | |
|---|---|---|---|---|
| 987,368 | A | 3/1911 | Hyatt | |
| 1,110,487 | A | 9/1914 | Hillerich | |
| 1,367,492 | A | 2/1921 | Miles | |
| 1,480,658 | A | 1/1924 | Bostock | |
| 1,611,858 | A | 12/1926 | Middlekauff | |
| 1,644,801 | A | 10/1927 | VanDer Werff | |
| 2,039,221 | A | 4/1936 | Hillerich | |
| 2,101,542 | A | 12/1937 | Hartzell | |
| 2,370,033 | A | 2/1945 | Hall | |
| 2,458,919 | A | 1/1949 | Marsden | |
| 2,488,301 | A | 11/1949 | Lundstrom | |
| 2,694,661 | A * | 11/1954 | Meyer | 156/155 |
| 2,793,859 | A | 5/1957 | Darling et al. | |
| 3,024,819 | A * | 3/1962 | Dosker | 144/359 |
| 3,785,277 | A * | 1/1974 | Schmitt | 100/41 |
| 3,812,846 | A * | 5/1974 | Trout | 601/116 |
| 3,826,188 | A * | 7/1974 | Eberle | 100/100 |
| 3,971,423 | A * | 7/1976 | Miller | 144/176 |
| 4,078,592 | A * | 3/1978 | Standal | 144/208 |
| 4,116,252 | A | 9/1978 | Ikeda | |
| 4,136,722 | A | 1/1979 | Travis | |
| 4,428,410 | A | 1/1984 | Strandberg | |
| 4,714,251 | A | 12/1987 | Cook | |
| 5,190,088 | A | 3/1993 | Thomassen et al. | |
| 5,343,913 | A | 9/1994 | Tanahashi et al. | |

(Continued)

*Primary Examiner*—Dana Ross
*Assistant Examiner*—Jennifer Chiang
(74) *Attorney, Agent, or Firm*—Sperry, Zoda & Kane

(57) ABSTRACT

An apparatus for hardening the hitting head area of a wooden baseball bat by compressing of the wooden fibers on the surface thereof which includes a base housing assembly with a track and a carriage assembly with a rail member. The rail member and the track are engageable together to facilitate movement of the carriage assembly with respect to the base housing assembly. A compression roller is mounted to the housing and a bat is retained to the carriage adjacent the roller. The roller is biased into abutment with the bat for compressing the wooden fibers of hitting surface to increase the hitting power thereof as the carriage with the bat mounted thereof is manually powered for abutting movement along the adjacent compressing roller. The bat can be selectively mounted in a bat receiving zone defined by a plurality of U-shaped retaining brackets mounted to the carriage assembly.

19 Claims, 7 Drawing Sheets

U.S. PATENT DOCUMENTS 5,800,293 A 9/1998 MacKay, Jr.
5,810,965 A * 9/1998 Fwu ..... 156/359
5,894,873 A * 4/1999 Weeks ..... 144/4.6
5,904,194 A 5/1999 Castwall et al.
6,047,751 A * 4/2000 An ..... 144/361
6,053,224 A 4/2000 Hellgren et al.
6,079,325 A * 6/2000 LePoire et al. ..... 100/210
6,083,126 A 7/2000 Gentile
6,234,000 B1 5/2001 Bowling
6,432,007 B1 8/2002 Filice et al.
6,471,608 B1 10/2002 Mitchell
6,711,996 B1 * 3/2004 Mackie ..... 100/169
7,097,578 B2 * 8/2006 Guenther et al. ..... 473/567

* cited by examiner

APPARATUS FOR HARDENING THE HEAD AREA OF A WOODEN BASEBALL BAT

The present utility application hereby formally claims priority of currently pending U.S. Provisional Patent application No. 60/934,590 filed Jun. 15, 2007 on "APPARATUS FOR HARDENING THE EXTERIOR SURFACE OF A WOODEN IMPLENENT" filed by the same inventor listed herein, namely, William H. Gill, and said referenced provisional application is hereby formally incorporated by reference as an integral part of the present application.

BACKGROUND OF THE INVENTION

1. Field of the Invention

This invention relates to devices used for hardening of the exterior surfaces of wooden baseball bats. Such baseball bats were often hardened by using a hard portable hand implement such as a bone or other similar hardened item which is moved into compressing abutment with the exterior surface of the hitting or head area of bat for moving therealong for compressing of the wooden fibers immediately adjacent to the external surface. This compressing step tends to substantially harden the hitting head of a wooden bat for enhancing power during hitting a baseball therewith and it also minimizes breakage. This is a common longstanding practice utilized for hardening of wooden baseball bats. The present invention provides a apparatus to achieve this hardening more easily and more completely and with much less physical effort.

2. Description of the Prior Art

A number of different devices have been designed for the purposes of enhancing the performance of wooden baseball bats such as shown in U.S. Pat. No. 987,368 patented Mar. 21, 1911 to J. W. Hyatt on a "Compressed Wooden Article And Method Of Producing The Same"; and U.S. Pat. No. 1,110,487 patented Sep. 15, 1914 to J. A. Hillerich and assigned to J. F. Hillerich & Son Company, Incorporated on a "Bat"; and U.S. Pat. No. 1,367,492 patented Feb. 1, 1921 to G. B. Miles on a "Baseball Bat And Method Of Making Same"; and U.S. Pat. No. 1,480,658 patented Jan. 15, 1924 to W. F. Bostock and assigned to United She Machinery Corporation on "Manufacture Of Wooden Articles; and U.S. Pat. No. 1,611,858 patented Dec. 21, 1926 to I. Middlekauff and assigned to Union Hardware Company on a "Baseball Bat"; and U.S. Pat. No. 1,644,801 patented Oct. 11, 1927 to A. H. Van Der Werff and assigned to N. V. Maatschappij Ago on a "Method Of Treating Wood"; and U.S. Pat. No. 2,039,221 patented Apr. 28, 1936 to J. A. Hillerich and assigned to Hillerich & Bradsby Co. on "Treatment Of Wood For Baseball Bats"; and U.S. Pat. No. 2,101,542 patented Dec. 7, 1937 to R. N. Hartzell and assigned to Hartzell Industries, Inc. on a "Method Of Compressing Wood"; and U.S. Pat. No. 2,370,033 patented Feb. 20, 1945 to H. W. Hall on a "Laminated Article And Method Of Manufacture"; and U.S. Pat. No. 2,458,919 patented Jan. 11, 1949 to J. E. Marsden on a "Baseball Bat"; and U.S. Pat. No. 2,488,301 patented Nov. 15, 1949 to C. B. Lundstrom on a "Furniture Component With Hardened Exposed Surfaces"; and U.S. Pat. No. 2,739,859 patented May 28, 1957 to H. F. Darling et al on a "Baseball Bat And Method Of Making The Same"; and U.S. Pat. No. 4,116,252 patented Sep. 26, 1978 to Yosaku Ikeda on a "Method And Apparatus For Producing Baseball Bats"; and U.S. Pat. No. 4,136,722 patented Jan. 30, 1979 to Charles F. Travis on a "Method Of Making Impact Delivery In Striking Members From Compressed Wood Veneers"; and U.S. Pat. No. 4,428,410 patented Jan. 31, 1984 to Anders Strandberg and assigned to AB Nils Darje on a "Method For Compressing Wooden Elements"; and U.S. Pat. No. 4,714,251 patented Dec. 22, 1987 to David C. Cook and assigned to Thomas O. Cook on a "Ball Bat"; and U.S. Pat. No. 5,190,088 patented Mar. 2, 1993 to Thomas Thomassen et al and assigned to Dansk Teknologisk Institut on a "Method And Apparatus For Compressing A Wood Sample"; and U.S. Pat. No. 5,343,913 patented Sep. 6, 1994 to Mitsuhiko Tanahashi et al and assigned to Hisaka Works Limited and Mitusuhiko Tanahashi on a "Wood Treating Method And Apparatus"; and U.S. Pat. No. 5,800,293 patented Sep. 1, 1998 to Jack W. MacKay, Jr. and assigned to Hillerich & Bradsby on a "Laminated Wood Bat And Method Of Making Same"; and U.S. Pat. No. 5,904,194 patented May 18, 1999 to Lennart Castwall et al on a "Method For Producing A Hard Wood Element"; and U.S. Pat. No. 6,047,751 patented Apr. 11, 2000 to Sun-Tae An on a "Method And Apparatus For Increasing The Hardness And Intensity Of Wood"; and U.S. Pat. No. 6,053,224 patented Apr. 25, 2000 to Keijo Hellgren et al and assigned to Asea Brown Boveri AB on a "Device For Pressure Treatment of Wood"; and U.S. Pat. No. 6,083,126 patented Jul. 4, 2000 to Robert Gentile on a "Ball Bat"; and U.S. Pat. No. 6,234,000 patented May 22, 2001 to Wiley I. Bowling on a "Ball-Bat Repairing Method"; and U.S. Pat. No. 6,432,007 patented Aug. 13, 2002 to Gary W. Filice et al and assigned to Jas. D. Easton, Inc. on a "Governed Performance Hard Shell Bat"; and U.S. Pat. No. 6,471,608 patented Oct. 29, 2002 to Joseph D. Mitchell on a "Breakage-Resistant Baseball Bat And Production Thereof".

SUMMARY OF THE INVENTION

The present invention provides an apparatus designed specifically for the hardening of the head area of a wooden baseball bat for increasing hitting characteristics thereof. Such wooden baseball bats normally include a handle area to facilitate gripping thereof and a head area designed to be brought into contact with a thrown baseball when playing this sport.

This apparatus preferably includes a carriage assembly which will preferably define a bat receiving zone defined therealong for facilitating the detachable retaining of a wooden baseball bat to the carriage assembly such that it is movable therewith. The carriage assembly preferably includes a carriage platform member with a bat retaining mechanism to receive and detachably retain a wooden baseball bat with respect to the carriage platform to be movable therewith. This bat retaining mechanism can include individual bat retaining brackets. The carriage assembly also includes a carriage rail secured to the carriage platform member which extends outwardly therefrom to facilitate movement of the carriage assembly.

The apparatus further includes a base assembly including a base member with a track secured thereto and extending longitudinally therealong. This track is designed to be engageable with respect to the rail of the carriage assembly in order to facilitate longitudinal movement of the carriage assembly and a wooden baseball bat retained within the bat receiving zone thereof with respect to the base housing assembly. The base housing assembly also includes a housing mounted upon the base and extending outwardly therefrom around the track. A compression roller is preferably attached to the housing at a position extending toward the track for facilitating direct abutment thereof with respect to the head area of a bat retained within the bat receiving zone of the carriage assembly positioned with the carriage rail thereof in movable engagement with respect to the track. The present invention further also includes a flexibly resilient biasing mechanism attached with respect to the compression roller for exerting force therefrom and urging it into compressing abutment with respect to the head area of a wooden baseball bat located within the bat receiving zone of a carriage assembly for compressing the surface area of the head area of a wooden baseball bat responsive to movement of the carriage assembly with respect to the base housing assembly along the track thereof.

In the preferred configuration the bat retaining mechanism of the present invention includes a bat handle retaining bracket attached to the carriage platform member which is adapted to receive and detachably retain the handle area of the baseball with respect to the carriage platform member. The bat retaining mechanism preferably further includes a bat head retaining bracket mounted on the carriage platform at a position thereon spatially disposed from the bat handle retaining bracket. This bat head retaining bracket is preferably adapted to receive and detachably retain the head area of a wooden baseball bat with respect to the carriage platform member. The bat head retaining bracket and the bat handle retaining bracket are spaced apart in such a manner as to define the bat receiving zone therebetween.

The base housing assembly will also preferably include a compression arm movably attached to the housing at a position adjacent to the track. The compression roller will be attached with respect to the compression arm to be movable therewith. The flexibly resilient biasing mechanism will be attached to the compression arm for facilitating movement thereof for urging the compression roller into biased abutment with respect to the wooden baseball bat located thereadjacent and traveling thereunder. The compression roller is attached to the compression arm extending toward the track to facilitate direct abutment thereof with respect to the head area of a bat retained within the bat receiving zone of a carriage assembly positioned with the carriage rail thereof in movable engagement with respect to the track.

In a further preferred configuration the flexibly resilient biasing mechanism will include multiple pairs of spring members secured to individual spring pins mounted within the compression arm to facilitate the capability of adjusting the amount of biasing force exerted by the compression roller against the surface of the hitting area of the wooden bat positioned thereadjacent. Any number of individual spring members can be included for varying this pressure such that the apparatus of the present invention is usable with bats made of various different wood materials. Also this adjustable force capability allows the use of a minimal amount of force initially and a greater amount of force during the latter stages of hardening of the surface of the head area of a wooden baseball bat.

Ease of movement of the carriage rail of the carriage assembly with respect to the track of the base housing is achieved by positioning a first and second roller in the lower portion of the track. These rollers greatly facilitate the capability of relative movement of the carriage rail relative to the track of the base housing assembly.

The bat handle retaining bracket of the present invention preferably is adjustably positioned with respect to the carriage platform to facilitate use of the apparatus of the present invention with bats having various lengths and configurations. Also an intermediate bat supporting bracket can be included in the carriage platform positioned between the bat handle retaining bracket and the bat head retaining bracket to further facilitate support of a bat held within the bat receiving zone. Leather covering materials can be positioned extending over the various brackets of the bat retaining means to minimize damaging or scoring of the bat surfaces.

It is an object of the apparatus for hardening the exterior surface of a wooden baseball bat of the present invention to facilitate hardening of baseball bats made from various different types of wood.

It is an object of the apparatus for hardening the exterior surface of a wooden baseball bat of the present invention to aid in the maintenance of baseball bats by minimizing damaging thereto.

It is an object of the apparatus for hardening the exterior surface of a wooden baseball bat of the present invention to greatly facilitate performance by providing a hardened surface in the hitting area of a baseball bat without requiring any hardening of the handle area thereof.

It is an object of the apparatus for hardening the exterior surface of a wooden baseball bat of the present invention to minimize the effort required for hardening the wooden fibers in the head area of a conventional baseball bat.

It is an object of the apparatus for hardening the exterior surface of a wooden baseball bat of the present invention to be capable of moving the wooden baseball bat relative to a hardening roller head to facilitate compressing of the wooden fibers in the wooden hitting head surface thereof.

It is an object of the apparatus for hardening the exterior surface of a wooden baseball bat of the present invention to have a minimum number of moving parts.

It is an object of the apparatus for hardening the exterior surface of a wooden baseball bat of the present invention to have minimum maintenance requirements.

It is an object of the apparatus for hardening the exterior surface of a wooden baseball bat of the present invention to be capable of use with wooden baseball bats of various sizes, lengths and configurations.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
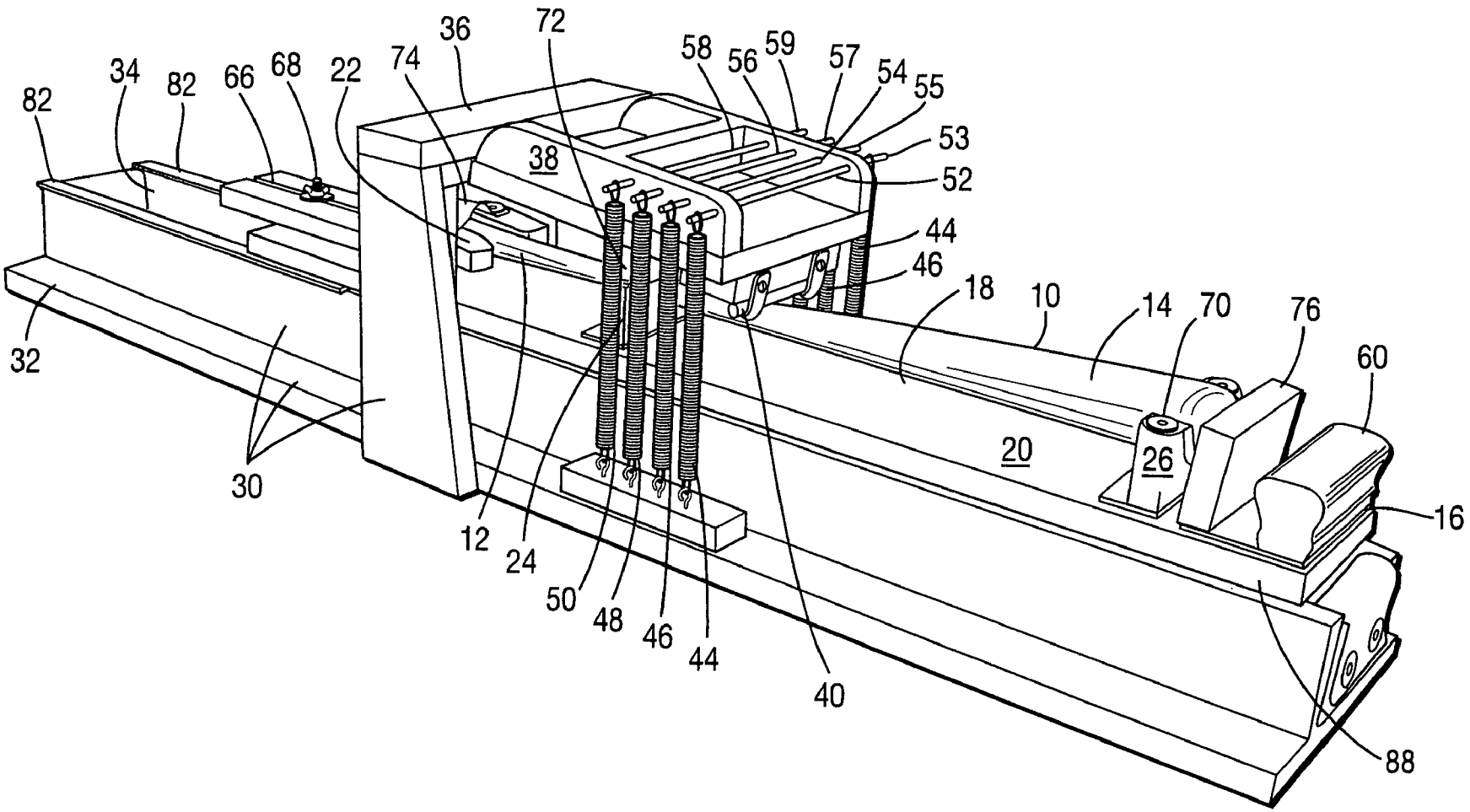
FIG. 1 is a perspective illustration of an embodiment of an apparatus for hardening the head area of a wooden baseball bat of the present invention shown in the first position with the roller contacting the intermediate portion of the bat.

The present invention provides an apparatus for enhancing the hitting characteristics of a wooden baseball bat 10. Such baseball bats used within the game of baseball include a handle area 12 for gripping and a head area 14 also defined as the hitting surface. In the game of baseball a hitter will grasp the handle area 12 and swing the wooden bat 10 in such a manner that the head area 14 and in particular the hitting surface thereof will contact a pitched ball. The hitting characteristics of the hitting surface 14 of a wooden baseball bat 10 can be significantly enhanced by compression of the exterior surface thereof. The present invention provides an apparatus for manually performing this more easily and completely and efficiently.

The apparatus of the present invention includes a carriage assembly 16 movably mounted within a base housing assembly 30. The base housing assembly 30 will define a track means 34 adapted to receive a carriage rail means 28 of the carriage assembly 16. Preferably the track means 34 of the base housing assembly 30 is a generally U-shaped member which extends longitudinally along the length of the base housing assembly 30 and receives the carriage rail 28 positioned therein. In the configuration shown in this particular embodiment the carriage rail means 28 comprises two vertically extending planar members extendable into the U-shaped track 34 of the base housing assembly 30.

Carriage assembly 16 preferably includes a carriage platform member 20 with a bat retaining means 21 secured in this embodiment to the upper surface thereof. The bat retaining means 21 is adapted to hold a wooden baseball bat 10 within a bat receiving zone 18 defined by the bat retaining means 21.

In the preferred configuration of this embodiment the bat retaining means 21 will include a bat handle retaining bracket 22 for selectively and detachably holding of the handle area 12 of a wooden baseball bat within the bat receiving zone 18. Preferably the bat handle retaining bracket 22 will be secured to the upper surface of the carriage platform member 20.

The bat retaining means 21 will further preferably include a bat head retaining bracket 26 also preferably secured with respect to the carriage platform member 20 which is adapted to detachably receive and retain the head area 14 of a wooden baseball bat 10 therewithin. The bat head retaining bracket 26 is spatially disposed from the bat handle retaining bracket 22 at a sufficient distance such that the wooden baseball bat 10 can be placed therebetween and this area is defined as the bat receiving zone 18. A bat can be detachably secured therewithin to facilitate hardening of the head area 14 thereof by the apparatus of the present invention. Further support for holding and retaining detachably of the bat within the bat receiving zone 18 can be provided by defining the bat retaining means 21 to further include an intermediate bat support bracket 24 as further shown in FIG. 11 and FIG. 1. This intermediate bat support bracket 24 will support the intermediate area of a wooden baseball bat 10 such as the area between the handle area 12 and the hitting area 18 thereof.

In this manner a wooden baseball bat 10 can be detachably securable with respect to the carriage platform member 20 of the carriage assembly 16 to be movable therewith as the carriage assembly 16 is moved relative to the base housing assembly 30 with the carriage rail 28 thereof in engagement with respect to the track 34.

The base housing assembly 30 of the present invention preferably includes in this embodiment a base member 32 and a housing means 36. A track means 34 is defined extending along the base and the housing is positioned preferably extending above and around the track 34. A compression roller 40 is mounted with respect to the housing 36 such that the compression roller will contact a wooden baseball bat 10 as the carriage assembly 16 holding the bat is moved relative to the base housing assembly 30.

Preferably the compression roller 40 is mounted to a compression arm means 38. Compression arm means 38 is preferably pivotally mounted with respect to the housing means 36 at a position adjacent to the track means 34 of the base housing assembly 30 in such a manner that the compression roller 40 will be brought into abutting contact with a wooden baseball bat 10 retained within the bat receiving zone 18 as the carriage assembly 16 is moved relative to the base housing assembly 30.

To facilitate engagement between the compression roller 40 and the head area 14 of a wooden baseball bat 10 a flexibly resilient biasing means 42 is included in the present invention. As shown in this embodiment this flexibly resilient biasing means 42 includes a plurality of pairs of spring members which urge the compression arm 38 to pivot downwardly as shown in FIG. 1 such that the compression roller 40 is brought into a forcibly biased abutting contact with the exterior surface of the head area 14 of a wooden baseball bat 10 positioned in the bat receiving zone 18 of the carriage assembly 16.

The configuration of the flexibly resilient biasing means 42 can be provided by any means of flexibly biasing the compression roller 40 toward the wooden baseball bat 10 therebelow. However, in the embodiment shown herein, this flexibly resilient bias is achieved by the use of multiple pairs of spring members. In the specific configuration of this embodiment the compression arm 38 will include a first spring pin 52 and a second spring pin 54 and a third spring pin 56 and a fourth spring pin 58 extending laterally therethrough. Each of these pins will include a pair of outwardly extending ends on opposite lateral sides of the compression arm 38. The first spring pin 52 will include first pin ends 53 extending outwardly and oppositely from the compression arm 38. Similarly the second spring pin 54 will include second pin ends 55 extending laterally outwardly from the compression arm 38 at a position slightly spatially disposed from the first pin ends 53. A pair of third pin ends 57 will extend laterally and oppositely outwardly from the compression arm means 38 at a position spatially disposed from the first pin ends 53 and from the second pin ends 55. Finally the fourth spring pin 58 will include a pair of fourth pin ends 59 extending laterally outwardly from the compression arm means 38 at a position spatially disposed from the first pin ends 53 and the second pin ends 55 and the third pin ends 57.

As shown in the figures these pin ends will preferably be equally spaced from one another and provide alternate locations for securing of individual spring members thereto. Preferably the present invention will include four pairs of spring members including a first pair of spring members 44 secured to the base member 32 of the base housing assembly 30 and secured with respect to the first pin ends 53. Also included preferably will be a second pair of spring members 46 which are secured at one end to the base member 32 and at the opposite end to the second pin ends 55. Similarly a third pair of spring member 48 will be included extending from the base member 32 to the third pin ends 57. Finally a fourth pair of spring member 50 will be included preferably attached at one end to the base member 32 and at the opposite end to the fourth pin ends 59. It should be appreciated that the apparatus of the preferred embodiment of the present invention can be used with a single pair of spring members that would be either first pair 44 or second pair 46 or third pair 48 or fourth pair 50. However, the placement of additional springs provides further forcible bias for urging abutment of the compression roller 40 with respect to the hitting surface 14 of the bat 10.

The use of multiple pairs of springs 44, 46, 48 and 50 provides the capability for adjusting the amount of forcible bias exerted by the compression arm 38 and more directly by the compression roller 40 with respect to the head area 14 of the bat 10. The use of one pair of springs can be used to provide an initial level of hardening and additional pairs of springs can be utilized to gradually increase the force of compression of the wooden fibers in the exterior surface of the head area 14 of bat 10.

The actual hardening of the head area 14 of the bat 10 is achieved by longitudinal movement of the carriage assembly 16 along the base assembly 30 with the carriage rail 28 in engagement with respect to the track means 34. To facilitate this movement a grasping means 60 can be provided which a person can use to forcibly urge longitudinal movement of the carriage 16 relative to the base housing 30. This back and forth movement can be performed several times. Once the immediate upwardly facing portion of the bat 10 is hardened the bat can be easily slightly rotated within the bat receiving zone 18 to achieve hardening of an immediate lateral area. In this manner, once the wooden baseball bat 10 has been completely rotated, all areas of the hitting surface 14 thereof can be hardened. It should be appreciated that the force needed for longitudinal movement of the carriage 16 relative to the base housing 30 can be significant and for this reason the grasping means 60 can provide the additional force required to maximize the hardening of the hitting surface 14 of bat 10.

Figure 6:
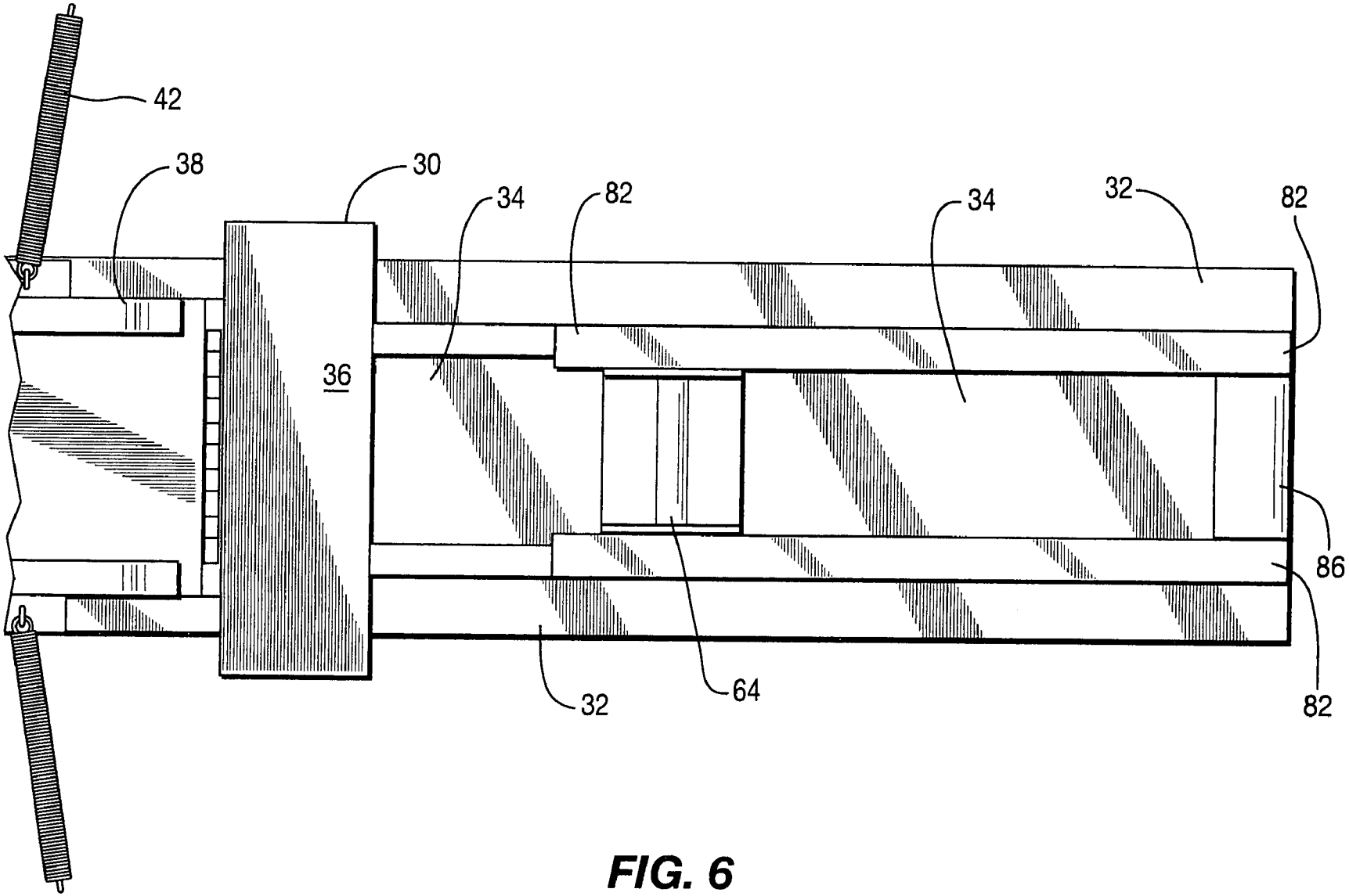
FIG. 6 is a top plan view of the portion of the base housing assembly immediately adjacent to the second end stop member thereof illustrated with the carriage assembly removed for clarity.

Ease of movement between the carriage assembly 16 and the base housing assembly 30 is an important characteristic of the present invention. For this reason the track 34 of the base housing 30 will preferably include a first roller means 62 and a second roller means 64 located therewithin to facilitate movement of the carriage rail 28 relative to the track 34. The first roller means 62 and the second roller means 64 are best shown in the top plan views of FIGS. 6 and 7. These figures also clearly show the first end stop member 84 and the second end stop member 86. First end stop member 84 is located at one end of the track 34 of base housing 30 in the same portion thereof containing the first roller 62. The second end stop member 86 shown in FIG. 6 is located in the opposite end of the base housing 30 in the section thereof also containing the second roller means 64.

With this construction the carriage assembly 16 is movable to a first position 88 wherein the carriage rail means 28 thereof is brought into abutting contact with respect to the first end stop member 84. At this position the compression roller means 40 will be in contact with the intermediate portion of the bat 10 in an area between the hitting area 14 and the handle area 12.

Figure 2:
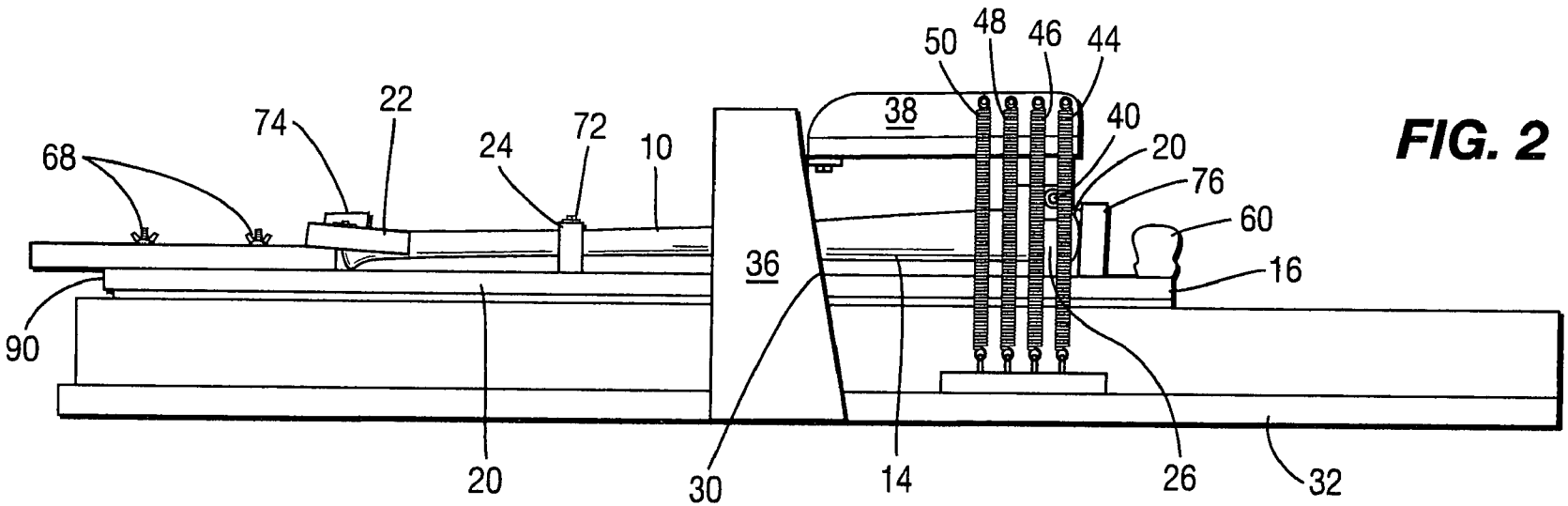
FIG. 2 is a front plan view of the embodiment shown in FIG. 1 located in the second position with the roller in contact with the head area of the wooden baseball bat.
Figure 3:
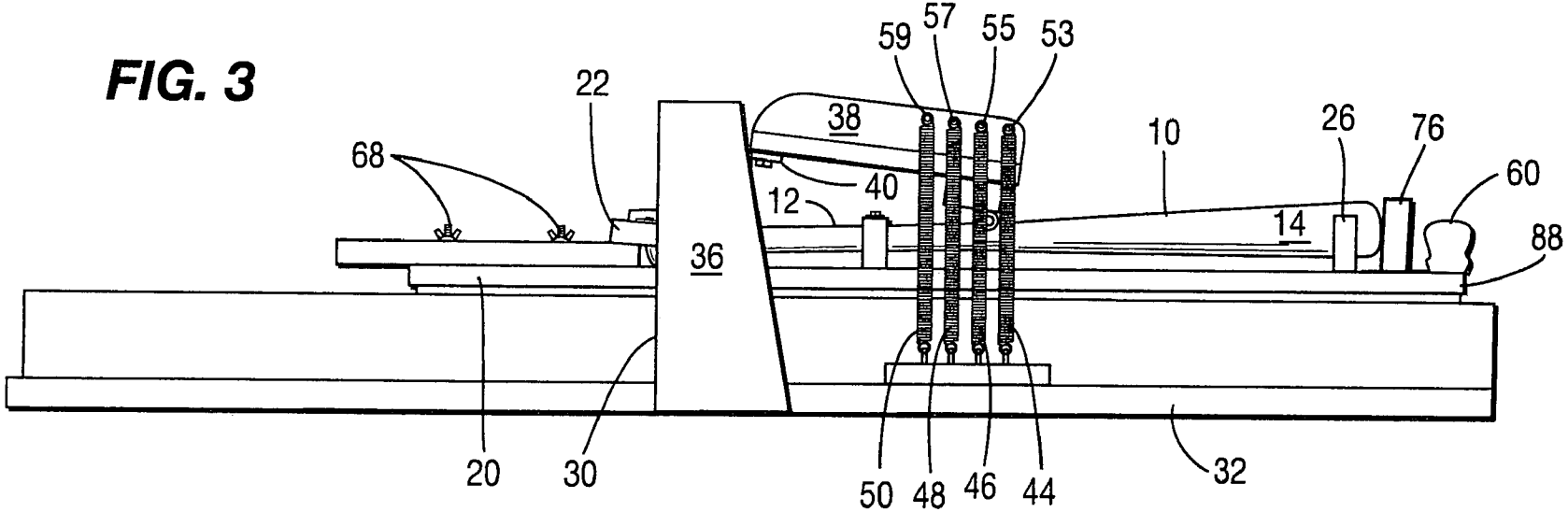
FIG. 3 is a front plan view of the embodiment shown in FIG. 1.
Figure 4:
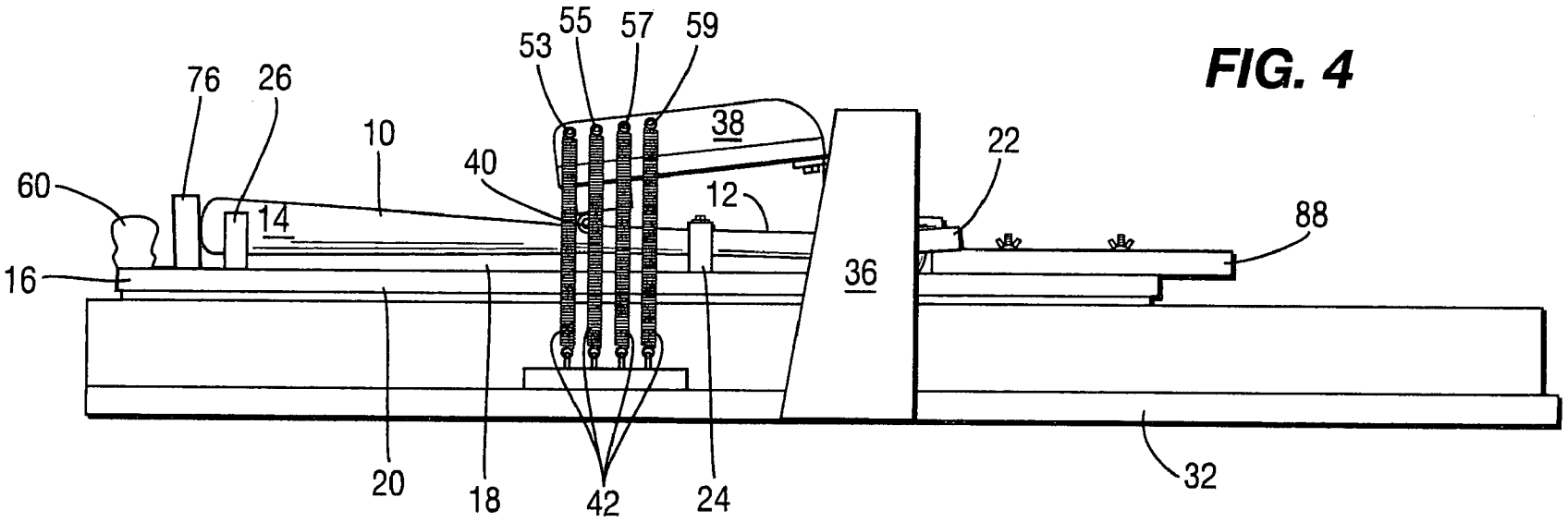
FIG. 4 is a rear plan view of the embodiment shown in FIG. 3.
Figure 5:
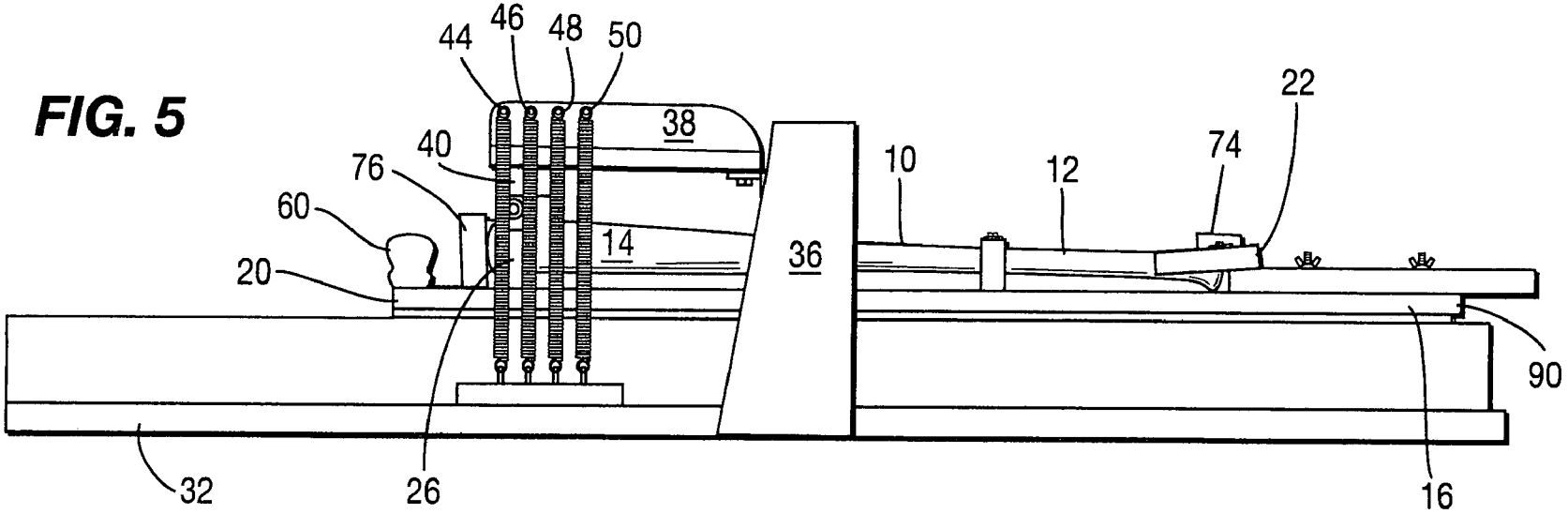
FIG. 5 is a rear plan view of the configuration of FIG. 1 shown in the second position with the roller in contact with the head area of a wooden baseball bat.

The grasping means 60 can then have force exerted thereagainst manually by the user such that the carriage assembly 16 moves to the left as shown in FIG. 1 until the rail means 28 thereof is brought into abutting contact with respect to the second end stop member 86. Once contact is made with second end stop member 86 the carriage assembly 16 will be defined as being in the second position 90. FIG. 1 is a perspective illustration showing the carriage assembly 16 in the first position 88 and FIG. 2 is a side plan view showing the carriage assembly 16 in the second position 90.

Figure 8:
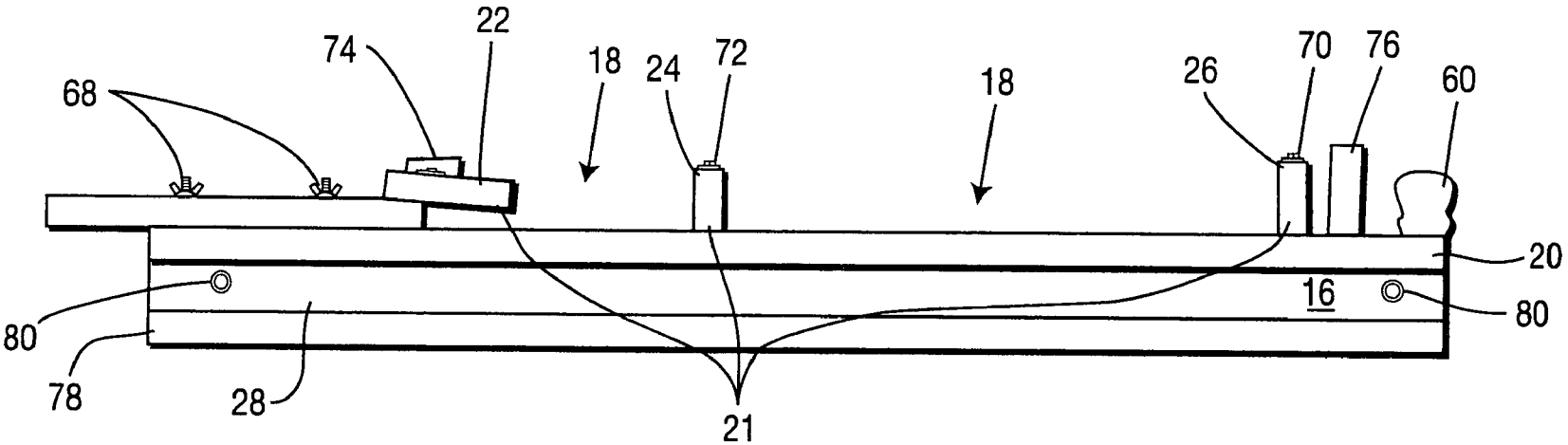
FIG. 8 is a front plan view of an embodiment of the carriage assembly of the present invention shown removed from the base housing assembly for clarity and purposes of illustration.
Figure 9:
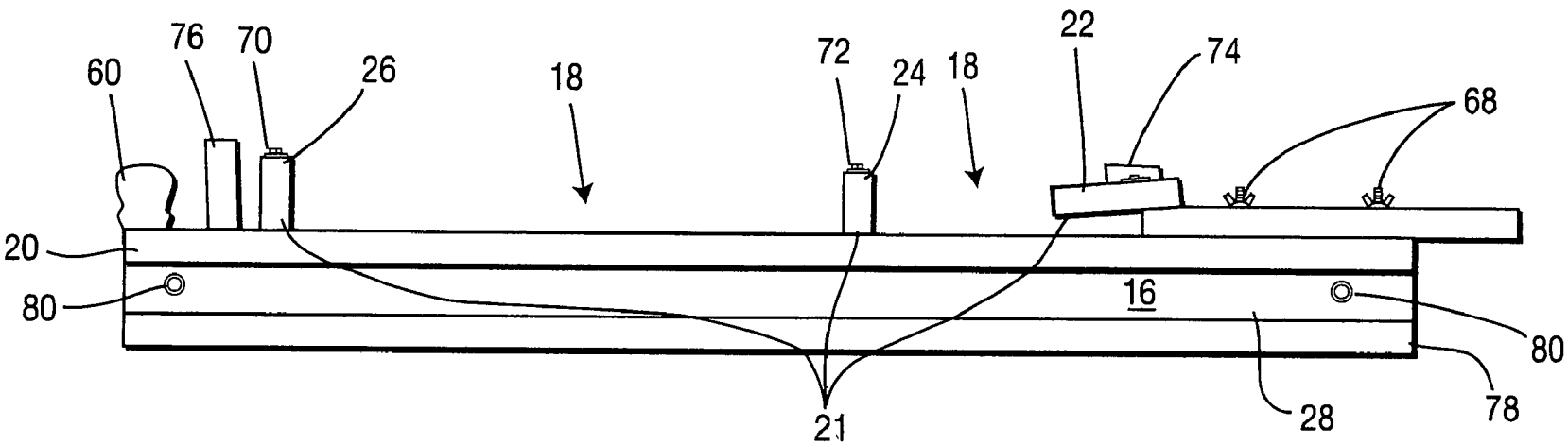
FIG. 9 is a rear pan view of an embodiment of the carriage assembly of the present invention shown removed from the base housing assembly for clarity and purposes of illustration.
Figure 10:
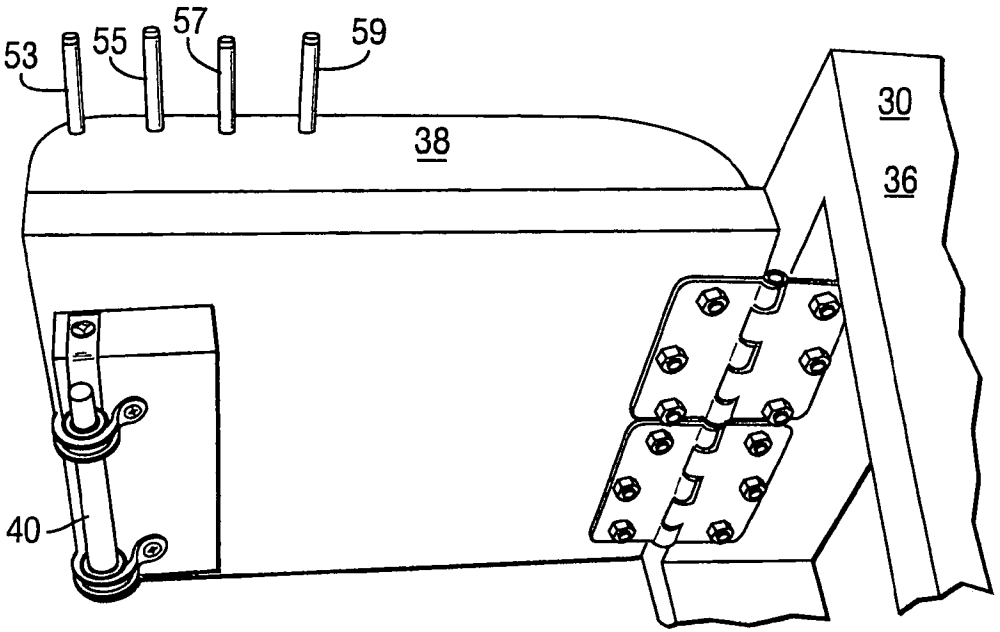
FIG. 10 is an exploded view showing the undersurface of an embodiment of the compression arm showing the use of a hinge for pivotal connection to the housing and clearly illustrating the compression roller.

Maintaining of alignment of the carriage rail means 28 within the track means 34 is an important consideration of the present invention. This alignment can be facilitated by the inclusion of ball roller means 80 mounted in the lateral side surfaces of the carriage rails 28. These ball rollers 80 are shown best in FIGS. 8 and 9. Ball roller members 80 extend outwardly and are brought into abutting contact with the inside of the generally U-shaped track means 34 of the base housing assembly 30 of this embodiment in order to maintain alignment and secure engagement between the carriage rail 28 and the track 34.

Figure 7:
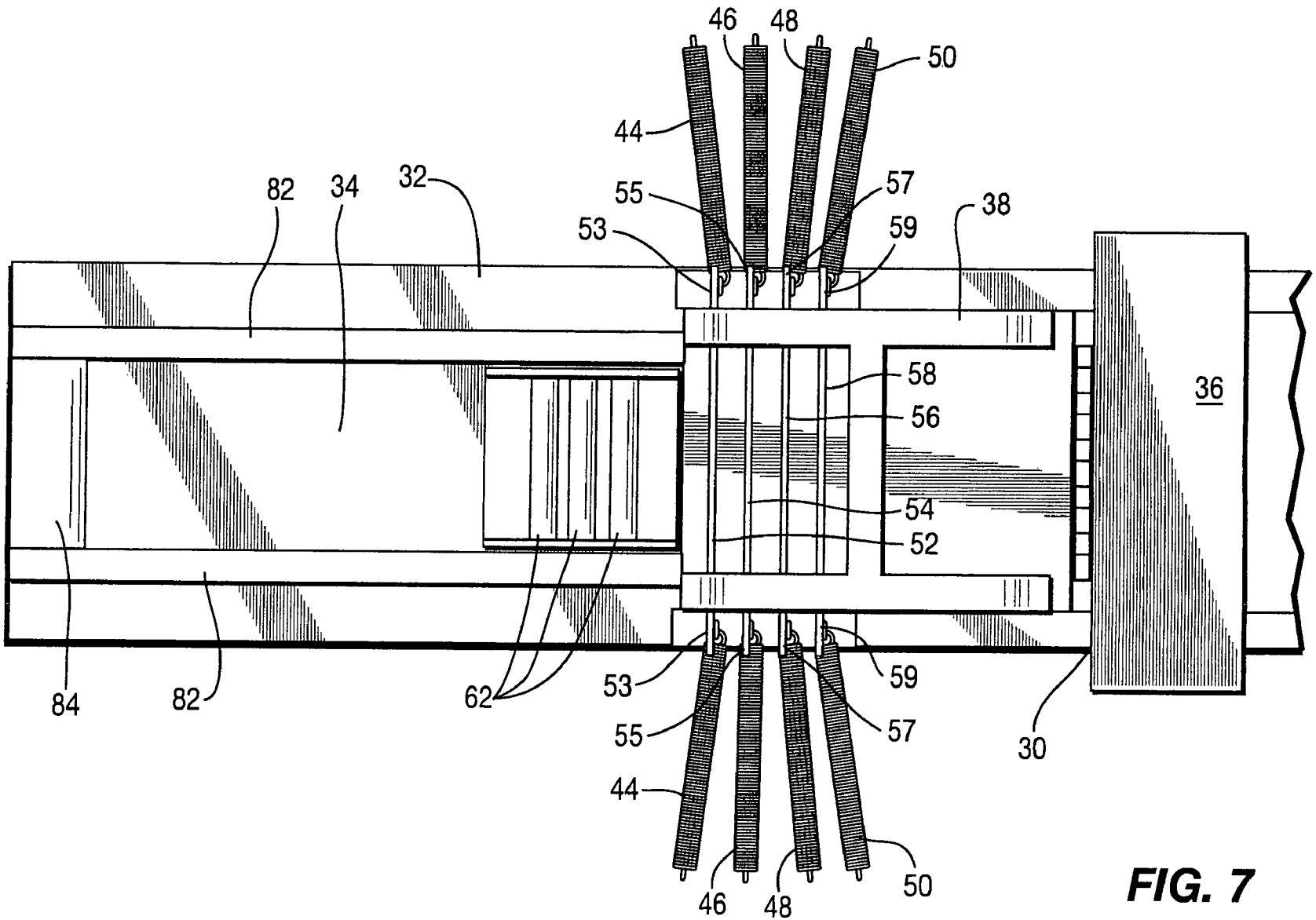
FIG. 7 is a top plan view of the portion of the base housing assembly immediately adjacent to the first end stop member thereof illustrated with the carriage assembly removed for clarity.

To further facilitate relative movement of the carriage rail 28 within the track 34 a plurality of metal runners 82 can be included. These runners are generally right angularly shaped and extend across the upwardly facing surfaces of the tracks 34 as shown in FIGS. 6 and 7. They provide wear resistance for the upwardly facing surfaces of the tracks 34. Preferably they are right angularly shaped such that they also extend downwardly along the interior walls of the vertical members that define the track 34 in such a manner that the laterally extending ball roller members 80 will also contact them and prevent gouging of the interior wall surfaces of the vertically extending panels of the tracks 34 by these normally metallic ball roller members 80. It is an important characteristic of the present invention that the apparatus be made as light as possible and therefore wood is the preferred material for the construction for the vertically extending panels that define the track means 34 and these metal runners 82 provide a means for preventing gouging and deterioration of the mating surfaces between the carriage rails 28 of the carriage assembly 16 and the tracks 34 of the base housing assembly 30.

Similarly the carriage rail means 28 will preferably be made of a wooden material and to minimize wear thereof and to enhance movable characteristics relative to the track 34 plastic liner sections 78 can extend along the lowermost edges of the carriage rails 28. These plastic liner sections 78 are shown best in FIGS. 8 and 9. The upper portion of the individual carriage rails 28 will be made of wood to take advantage of the lightweight characteristics thereof whereas the lower portion will comprise the plastic liner sections 78.

Figure 11:
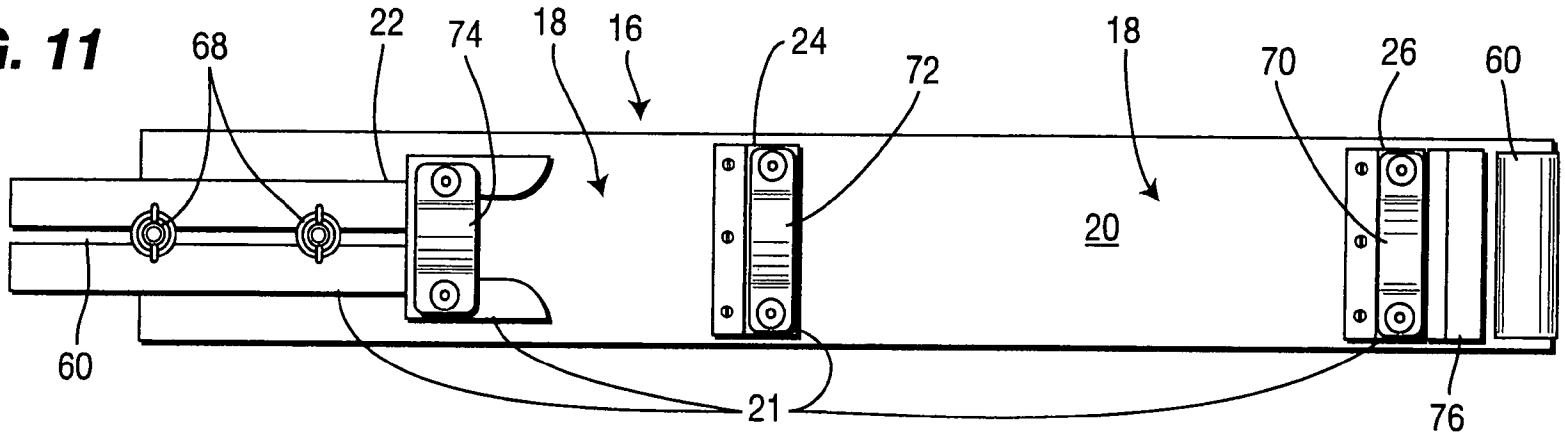
FIG. 11 is a top plan view of an embodiment of the carriage assembly of the present invention.

Baseball bats come in various sizes and lengths and it is important that the apparatus of the present invention be usable with different sizes and for this reason it is an important alternative configuration for the present invention to provide a capability for length adjustment of the size of the bat receiving zone 18 defined between the bat handle retaining bracket 22 and the bat head retaining bracket 26. This adjustability is provided by defining of the bat handle retaining bracket 22 in such a manner that it is adjustable with respect to the carriage platform member 20. This can be achieved by configuring the bat handle retaining bracket 22 with an adjustment slot 66 defined therein and further defining of the bat handle retaining bracket 22 with a threaded fastening means 68 which is in engagement with respect to the carriage platform member 20 and extends upwardly through the longitudinally extending adjustment slot 66 defined in the bat handle retaining bracket 22. This configuration is best shown in FIG. 11. In the configuration shown in FIG. 11 the threaded fastening means 68 includes wing nuts in the upper portion thereof. In this manner the position of the bat handle retaining bracket 22 can easily be adjusted relative to the fixed position of the bat head retaining bracket 26. Preferably the apparatus of the bat retaining means 21 will also include a bat head stop block 76 positioned between the grasping means 60 and the U-shaped portion of the bat head retaining bracket 26. In the preferred configuration shown in this embodiment the bat head retaining bracket 26 and the intermediate bat supporting bracket 24 both are upwardly facing U-shaped members which are easily adapted to receive any portion of the longitudinally extending round bat. Thus, when a bat 10 is inserted into the bat receiving zone 18, initially the handle area 12 thereof is slid into the bat handle retaining bracket 22. Thereafter the threaded fastening means 68 are loosened and the bat handle retaining bracket 22 as shown in FIG. 11 is slid to the right with the bat 10 gently supported by the upwardly facing U-shaped intermediate bat support bracket 24 and bat head retaining bracket 26. The bat and the bat handle retaining bracket 26 are slid to the right until the end of the bat contacts the bat head stop block 76. At this point the longitudinally extending dimension applicable for this specific bat has been determined and the threaded fastening means 68 or preferably the wing nuts can be tightened thereby temporarily affixing the bat handle retaining bracket 22 relative to the carriage platform 20. In this manner the wooden baseball bat 10 is now firmly and temporarily retained within the bat receiving zone 18 for facilitating hardening thereof by moving of the carriage assembly 16 relative to the base housing assembly 30 repeatedly with slight rotations of the bat within the zone 18 after each movement between the first and second positions 88 and 90.

It is important that scoring or damaging the external surface of a bat be prevented and for this reason a first leather cover means 70 is included in the configuration of the bat handle retaining bracket 22 to minimize damage thereof. Similarly a second leather cover means 72 can be included extending over the intermediate bat supporting bracket 24 to minimize scoring of the intermediate area of the bat 10. Also a third leather cover means 74 can be positioned extending over the bat head retaining bracket 26 to prevent scoring of the head area of the bat 10.

In this manner the present invention provides a unique apparatus for facilitating the hardening of the head area 14 of a wooden baseball bat 10 which is portable and can be used at a baseball field or within a locker room for hardening multiple bats within a very short time period and for maintaining the hardening characteristics of bats that have already been hardened.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. An apparatus for hardening the head area of a wooden baseball bat having a handle area for gripping thereof and a head area for hitting a baseball therewith, said apparatus comprising:

A. a carriage assembly defining a bat receiving zone therealong for detachably retaining a wooden baseball bat therewithin to be movable therewith, said carriage assembly including;

(1) a carriage platform member;

(2) a bat retainer to receive and detachably retain a wooden baseball bat with respect to said carriage platform member to be movable therewith, said bat retainer including:

a. a bat handle retaining bracket attached to said carriage platform member and adapted to receive and detachably retain the handle area of a baseball bat with respect to said carriage platform member;

b. a bat head retaining bracket mounted on said carriage platform member at a position thereon spatially disposed from said bat handle retaining bracket, said bat head retaining bracket being adapted to receive and detachably retain the head area of a wooden baseball bat with respect to said carriage platform member, said bat receiving zone being defined extending between said bat handle retaining bracket and said bat head retaining bracket, said bat handle retaining bracket being adjustably positionable with respect to said carriage platform member to provide adjustability in the distance between said bat handle retaining bracket and said bat head retaining bracket to facilitate secure positioning of wooden baseball bats of various different lengths within said bat receiving zone of said carriage assembly;

(3) a carriage rail secured to said carriage platform member and extending outwardly therefrom to facilitate movement of said carriage assembly;

B. a base housing assembly including:

(1) a base member;

(2) a track secured to said base member and extending longitudinally therealong, said track being engageable with respect to said carriage rail of said carriage assembly to facilitate longitudinal movement of said carriage assembly and a wooden baseball bat retained within said bat receiving zone defined thereon with respect to said base housing assembly;

(3) a housing mounted upon said base member and extending outwardly therefrom around said track;

(4) a compression roller attached with respect to said housing at a position extending toward said track for facilitating direct abutment thereof with respect to the head area of a bat retained within said bat receiving zone of a carriage assembly positioned with said carriage rail thereof in moveable engagement with respect to said track; and (5) a flexibly resilient biasing mechanism attached with respect to said compression roller for urging thereof into compressing abutment with respect to the head area of a wooden baseball base located within said bat receiving zone of said carriage assembly for compressing the surface of the head area of a wooden baseball bat responsive to movement of said carriage assembly with respect to said base housing assembly along said track thereof.

2. An apparatus for hardening the head area of a wooden baseball bat as defined in claim 1 wherein said base housing assembly further includes a compression arm moveably attached to said housing at a position adjacent to said track, said compression roller being attached with respect to said compression arm to be moveably therewith, said flexibly resilient biasing mechanism being attached to said compression arm for facilitating urging of said compression roller into biased abutment with respect to a wooden baseball bat thereadjacent, said compression roller being attached to said compression arm extending toward said track for facilitating direct abutment thereof with respect to the head area of a bat retained within said bat receiving zone of a carriage assembly positioned with said carriage rail thereof in moveable engagement with respect to said track.

3. An apparatus for hardening the head area of a wooden baseball bat as defined in claim 1 wherein said flexibly resilient biasing mechanism comprises at least one spring mechanism.

4. An apparatus for hardening the head area of a wooden baseball bat as defined in claim 2 wherein said flexibly resilient biasing mechanism comprises:

A. a first pair of spring members attachable to said base member and attachable with respect to said compression arm for exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof;

B. a second pair of spring members attachable to said base member and attachable with respect to said compression arm for selectively further exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof;

C. a third pair of spring members attachable to said base member and attachable with respect to said compression arm for further selectively exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof; and D. a fourth pair of spring members attachable to said base member and attachable with respect to said compression arm for further selectively increasing the force urging said compression roller into compressing abutment with respect to the head area of a wooden baseball bat located within said bat receiving zone of a carriage assembly for compressing the surface area thereof responsible to movement of said carriage assembly with respect to said base housing assembly along said track thereof.

5. An apparatus for hardening the head area of a wooden baseball bat as defined in claim 4 wherein said flexibly resilient biasing mechanism further comprises:

A. a first spring pin extending through said compression arm and including two first pin ends extending oppositely outwardly from said compression arm to be adapted to receive said first pair of spring members secured respectively thereto to facilitate attachment thereof to said compression arm for facilitating the applying of compressing force by said compression roller against the head area of a wooden bat positioned in abutment therewith;

B. a second spring pin extending through said compression arm and including two second pin ends extending oppositely outwardly from said compression arm to be adapted to receive said second pair of spring members secured respectively thereto to facilitate attachment thereof to said compression arm for facilitating the applying of additional compressing force by said compression roller against the head area of a wooden bat positioned in abutment therewith;

C. a third spring pin extending through said compression arm and including two third pin ends extending oppositely outwardly from said compression arm to be adapted to receive said third pair of spring members secured respectively thereto to facilitate attachment thereof to said compression arm for facilitating the applying of additional compressing force by said compression roller against the head area of a wooden bat positioned in abutment therewith; and D. a fourth spring pin extending through said compression arm and including two fourth pin ends extending oppositely outwardly from said compression arm to be adapted to receive said fourth pair of spring members secured respectively thereto to facilitate attachment thereof to said compression arm for facilitating the applying of additional compressing force by said compression roller against the head area of a wooden bat positioned in abutment therewith.

6. An apparatus for hardening the head area of a wooden baseball bat as defined in claim 1 wherein said track of said base housing assembly includes a first roller and a second roller, adjacent said track thereof, engageable with respect to said carriage rail of said carriage assembly to facilitate pivotal movement of said carriage assembly with respect to said base housing assembly, said second roller being spatially disposed from said first roller to facilitate movement of said carriage assembly when positioned with said carriage rail thereof in engagement with said track of said base housing assembly.

7. An apparatus for hardening the head area of a wooden baseball bat as defined in claim 1 wherein said bat handle retaining bracket defines an adjustment slot therewithin and also includes a threaded fastening mechanism extending through said carriage platform member and into and through said adjustment slot to be capable of being tightened after adjusting the position of said bat handle retaining bracket with respect to said bat head retaining bracket to facilitate placing wooden baseball bats of various different lengths within said bat receiving zone of said carriage assembly.

8. An apparatus for hardening the head area of a wooden baseball bat as defined in claim 1 further comprising an intermediate bat supporting bracket mounted upon said carriage platform member and positioned between said bat handle retaining bracket and said bat head retaining bracket to further facilitate support of a bat held within said bat receiving zone.

9. An apparatus for hardening the head area of a wooden baseball bat as defined in claim 8 wherein said bat handle retaining bracket and said intermediate bat supporting bracket and said bat head retaining bracket are each generally U-shaped to facilitate receiving and selectively retaining a wooden baseball bat therewithin and wherein said bat handle retaining bracket includes a first leather cover extending thereover to facilitate retaining of a wooden bat in engagement therewith out damaging thereof and wherein said intermediate bat supporting bracket includes a second leather cover extending thereover to facilitate retaining of a wooden bat in engagement therewith out damaging thereof and wherein said bat head retaining bracket includes a third leather cover extending thereover to facilitate retaining of a wooden bat in engagement therewith out damaging thereof.

10. An apparatus for hardening the head area of a wooden baseball bat as defined in claim 1 wherein said flexibly resilient biasing mechanism is adjustable to vary the force of compression exerted by said compression roller against the head area of a wooden baseball bat retained within said bat receiving zone of said carriage assembly.

11. An apparatus for hardening the head area of a wooden baseball bat as defined in claim 1 wherein said carriage assembly further includes a bat head stop block positioned immediately adjacent said bat head retaining bracket to facilitate positioning of the head area of a wooden baseball bat in abutment therewith to facilitate adjustable positioning of said bat handle retaining bracket for enhancing selective secure retaining of a bat within said bat receiving zone.

12. An apparatus for hardening the head area of a wooden baseball bat as defined in claim 1 wherein said carriage assembly further includes a grasping mechanism fixedly secured to said carriage platform member thereof to facilitate manual powering of longitudinal movement of a wooden bat retained within said bat receiving zone of said carriage assembly with respect to said compression roller of said base housing assembly.

13. An apparatus for hardening the head area of a wooden baseball bat as defined in claim 2 wherein said compression roller is rotatably moveably mounted with respect to said compression arm to facilitate maintaining of abutment thereof with respect to the head area of a wooden baseball bat positioned within said bat receiving zone.

14. An apparatus for hardening the head area of a wooden baseball bat as defined in claim 1 wherein said carriage rail of said carriage assembly includes plastic liner sections extending therealong which are adapted to directly abut said track of said base housing assembly to facilitate ease of relative movement therebetween and to minimize maintenance requirements result from wear of said carriage rails.

15. An apparatus for hardening the head area of a wooden baseball bat as defined in claim 1 wherein said carriage rail of said carriage assembly includes ball roller members mounted therein extending outwardly laterally therefrom which are adapted to abut said track of said base housing assembly to further facilitate ease of movement and alignment of said carriage assembly with respect to said track of said base housing assembly.

16. An apparatus for hardening the head area of a wooden baseball bat as defined in claim 1 wherein said track of said base housing assembly includes metal runners extending therealong to facilitate maintaining of alignment and engagement between said carriage rail of said carriage assembly and said track of said base housing assembly during movement of said carriage assembly with respect to said base housing assembly.

17. An apparatus for hardening the head area of a wooden baseball bat as defined in claim 1 wherein said track of said base housing assembly includes a first end stop member and a second end stop member with said carriage rail of said carriage assembly being moveable while engaged with respect to said track of said base housing assembly between a first position in abutment with said first end stop member and a second position in abutment with said second end stop member, movement of said carriage assembly between said first position and said second position being facilitating abutting contact of said compression roller along the entire length of the head area of a wooden baseball bat retained within said bat receiving zone for hardening the surface thereof.

18. An apparatus for hardening the head area of a wooden baseball bat having a handle area for gripping thereof and a head area for hitting a baseball therewith, said apparatus comprising:

A. a carriage assembly defining a bat receiving zone therealong for detachably retaining a wooden baseball bat therewithin to be movable therewith, said carriage assembly including;

(1) a carriage platform member;

(2) a bat handle retaining bracket attached to said carriage platform member and adapted to receive and detachably retain the handle area of a baseball bat with respect to said carriage platform member;

(3) a bat head retaining bracket mounted on said carriage platform member at a position thereon spatially disposed from said bat handle retaining bracket, said bat head retaining bracket being adapted to receive and detachably retain the head area of a wooden baseball bat with respect to said carriage platform member, said bat receiving zone being defined between said bat handle retaining bracket and said bat head retaining bracket, said bat handle retaining bracket defining an adjustment slot therewithin and also includes a threaded fastening mechanism extending through said carriage platform member and into and through said adjustment slot to be capable of being tightened after adjusting the position of said bat handle retaining bracket with respect to said bat head retaining bracket to facilitate placing wooden baseball bats of various different lengths within said bat receiving zone of said carriage assembly;

(4) an intermediate bat supporting bracket mounted upon said carriage platform member and positioned between said bat handle retaining bracket and said bat head retaining bracket to further facilitate support of a bat held within said bat receiving zone;

(5) a carriage rail secured to said carriage platform member and extending outwardly therefrom to facilitate movement of said carriage assembly;

(6) a grasping mechanism fixedly secured to said carriage platform member thereof to facilitate manual powering of longitudinal movement of said carriage assembly with a wooden bat retained within said bat receiving zone thereof;

(7) a bat head stop block positioned immediately adjacent said bat head retaining bracket to facilitate positioning of the head area of a wooden baseball bat in abutment therewith to facilitate adjustable positioning of said bat handle retaining bracket for enhancing selective retaining of a bat within said bat receiving zone securely;

B. a base housing assembly including:

(1) a base member;

(2) a track secured to said base member and extending longitudinally therealong, said track being engageable with respect to said carriage rail of said carriage assembly to facilitate longitudinal movement of said carriage assembly and a wooden baseball bat retained within said bat receiving zone defined thereon with respect to said base housing assembly, said track further including a first roller and a second roller, adjacent said track thereof, engageable with respect to said carriage rail of said carriage assembly to facilitate pivotal movement of said carriage assembly with respect to said base housing assembly, said second roller being spatially disposed from said first roller to facilitate movement of said carriage assembly when positioned with said carriage rail thereof in engagement with said track of base housing assembly, said track further including a first end stop member and a second end stop member with said carriage rail of said carriage assembly being moveable while engaged with respect to said track of said base housing assembly between a first position in abutment with said first end stop member and a second position in abutment with said second end stop member, movement of said carriage assembly between said first position and said second position being adapted to allow contact of said compression roller along the entire length of the head area of a wooden baseball bat retained within said bat receiving zone for facilitating hardening thereof;

(3) a housing mounted upon said base member and extending outwardly therefrom around said track;

(4) a compression arm pivotally attached to said housing at a position adjacent to said track;

(5) a compression roller attached with respect to said compression arm at a position adjacent said track for facilitating direct abutment thereof with respect to the head area of a bat retained within said bat receiving zone of a carriage assembly positioned with said carriage rail thereof in moveable engagement with respect to said track;

(6) a flexibly resilient biasing mechanism attached to said base member and attached with respect to said compression arm for urging said compression roller into compressing abutment with respect to the head area of a wooden baseball base located within said bat receiving zone of said carriage assembly for compressing the surface of the head area of a wooden baseball bat responsive to movement of said carriage assembly with respect to said base housing assembly along said track thereof and responsive to rotation of the wooden bat within said bat receiving zone, said flexibly resilient biasing mechanism being adjustable to vary the force of compression exerted by said compression roller against the head area of a wooden baseball bat retained within said bat receiving zone of said carriage assembly, said flexibly resilient biasing mechanism further comprising:

a. a first pair of spring members attachable to said base member and attachable with respect to said compression arm for exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof;

b. a second pair of spring members attachable to said base member and attachable with respect to said compression arm for selectively further exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof;

c. a third pair of spring members attachable to said base member and attachable with respect to said compression arm for further selectively exerting a force urging said compression roller into compressing abutment with respect to the head area of a wooden baseball bat positioned in said bat receiving zone of a carriage assembly for compressing the surface area thereof responsible to movement of said carriage assembly with respect to said base housing assembly along said track thereof;

d. a fourth pair of spring members attachable to said base member and attachable with respect to said compression arm for further selectively increasing the force urging said compression roller into compressing abutment with respect to the head area of a wooden baseball bat located within said bat receiving zone of a carriage assembly for compressing the surface area thereof responsible to movement of said carriage assembly with respect to said base housing assembly along said track thereof;

e. a first spring pin extending through said compression arm and including two first pin ends extending oppositely outwardly from said compression arm to be adapted to receive said first pair of spring members secured respectively thereto to facilitate attachment thereof to said compression arm for facilitating the applying of compressing force by said compression roller against the head area of a wooden bat positioned in abutment therewith;

f. a second spring pin extending through said compression arm and including two second pin ends extending oppositely outwardly from said compression arm to be adapted to receive said second pair of spring members secured respectively thereto to facilitate attachment thereof to said compression arm for facilitating the applying of additional compressing force by said compression roller against the head area of a wooden bat positioned in abutment therewith;

g. a third spring pin extending through said compression arm and including two third pin ends extending oppositely outwardly from said compression arm to be adapted to receive said third pair of spring members secured respectively thereto to facilitate attachment thereof to said compression arm for facilitating the applying of additional compressing force by said compression roller against the head area of a wooden bat positioned in abutment therewith; and h. a fourth spring pin extending through said compression arm and including two fourth pin ends extending oppositely outwardly from said compression arm to be adapted to receive said fourth pair of spring members secured respectively thereto to facilitate attachment thereof to said compression arm for facilitating the applying of additional compressing force by said compression roller against the head area of a wooden bat positioned in abutment therewith.

19. An apparatus for hardening the head area of a wooden baseball bat having a handle area for gripping thereof and a head area for hitting a baseball therewith, said apparatus comprising:

A. a carriage assembly defining a bat receiving zone therealong for detachably retaining a wooden baseball bat therewithin to be movable therewith, said carriage assembly including;

(1) a carriage platform member;

(2) a bat retainer to receive and detachably retain a wooden baseball bat with respect to said carriage platform member to be movable therewith;

(3) a carriage rail secured to said carriage platform member and extending outwardly therefrom to facilitate movement of said carriage assembly;

B. a base housing assembly including:

(1) a base member;

(2) a track secured to said base member and extending longitudinally therealong, said track being engagable with respect to said carriage rail of said carriage assembly to facilitate longitudinal movement of said carriage assembly and a wooden baseball bat retained within said bat receiving zone defined thereon with respect to said base housing assembly, said track including a first roller and a second roller engagable with respect to said carriage rail of said carriage assembly to facilitate pivotal movement of said carriage assembly with respect to said base housing assembly, said second roller being spatially disposed from said first roller to facilitate movement of said carriage assembly when positioned with said carriage rail thereof in engagement with said track of said base housing assembly;

(3) a housing mounted upon said base member and extending outwardly therefrom around said track;

(4) a compression roller attached with respect to said housing at a position extending toward said track for facilitating direct abutment thereof with respect to the head area of a bat retained within said bat receiving zone of a carriage assembly positioned with said carriage rail thereof in moveable engagement with respect to said track; and (5) a flexibly resilient biasing mechanism attached with respect to said compression roller for urging thereof into compressing abutment with respect to the head area of a wooden baseball base located within said bat receiving zone of said carriage assembly for compressing the surface of the head area of a wooden baseball bat responsive to movement of said carriage assembly with respect to said base housing assembly along said track thereof.

* * * * *

UNITED STATES PATENT AND TRADEMARK OFFICE

CERTIFICATE OF CORRECTION

PATENT NO. : 7,841,372 B2
APPLICATION NO. : 12/152476
DATED : November 30, 2010
INVENTOR(S) : William H. Gill It is certified that error appears in the above-identified patent and that said Letters Patent is hereby corrected as shown below:

In column 12, line 53, change “out” to -- without --.

In column 12, line 56, change “out” to -- without --.

In column 12, line 59, change “out” to -- without --.

Signed and Sealed this
Twenty-second Day of March, 2011

David J. Kappos

David J. Kappos
*Director of the United States Patent and Trademark Office*